United States Patent [19]

Fullam

[11] 4,445,742

[45] May 1, 1984

[54] ELECTRICAL CABLE CONNECTOR

[75] Inventor: Philip S. Fullam, Springfield, Ohio

[73] Assignee: The Yellow Springs Instrument Company, Inc., Yellow Springs, Ohio

[21] Appl. No.: 346,447

[22] Filed: Feb. 8, 1982

[51] Int. Cl.[3] ..... H01R 4/00; H01R 11/00

[52] U.S. Cl. ..... 339/61 M; 339/75 MP; 339/91 R

[58] Field of Search ..... 339/61 R, 61 M, 75 MP, 339/255 RT, 256 RT, 91 R, 91 B

[56] References Cited

U.S. PATENT DOCUMENTS

| | | | |
|---|---|---|---|
| 2,428,214 | 9/1947 | Gorey | 339/91 B |
| 2,802,188 | 8/1957 | Badders | 339/17 |
| 3,044,035 | 7/1962 | Adams, Jr. | 339/21 |
| 3,149,897 | 9/1964 | Martineck | 339/176 |
| 3,216,580 | 11/1963 | Fricker, Jr. | 211/4 |
| 3,737,833 | 6/1973 | Jerominek | 339/176 MP |
| 3,970,353 | 7/1976 | Kaufman | 339/75 |
| 4,008,942 | 2/1977 | Grossi | 339/91 |
| 4,129,351 | 12/1978 | Sugimoto et al. | 339/176 MP |
| 4,324,449 | 4/1982 | Watanabe et al. | 339/91 R |

FOREIGN PATENT DOCUMENTS 2324548 12/1973 Fed. Rep. of Germany .... 339/91 R

*Primary Examiner*—John McQuade
*Assistant Examiner*—Paula Austin
*Attorney, Agent, or Firm*—Biebel, French & Nauman

[57] ABSTRACT

An electrical connector has a first connector member including a plate-like body with retaining notches in the edges thereof, having a connector end and an attachment end, at least one strip of electrically conductive material on at least one face of the body extending from the connector end to the attachment end, and a lead wire anchored to the attachment end and attached to the strip, and a second connector member including a housing of resilient electrically insulating material forming a socket for receiving the body of the first connector member, a contact member located in the socket in position to contact the strip and having a portion for attachment to a second lead wire, and rigid retainer pins incorporated in the housing extending across the socket spaced apart to interfit with the notches, the pins being displaceable in the housing in response to insertion or withdrawal of the first connector member with respect to the second connector member.

5 Claims, 6 Drawing Figures

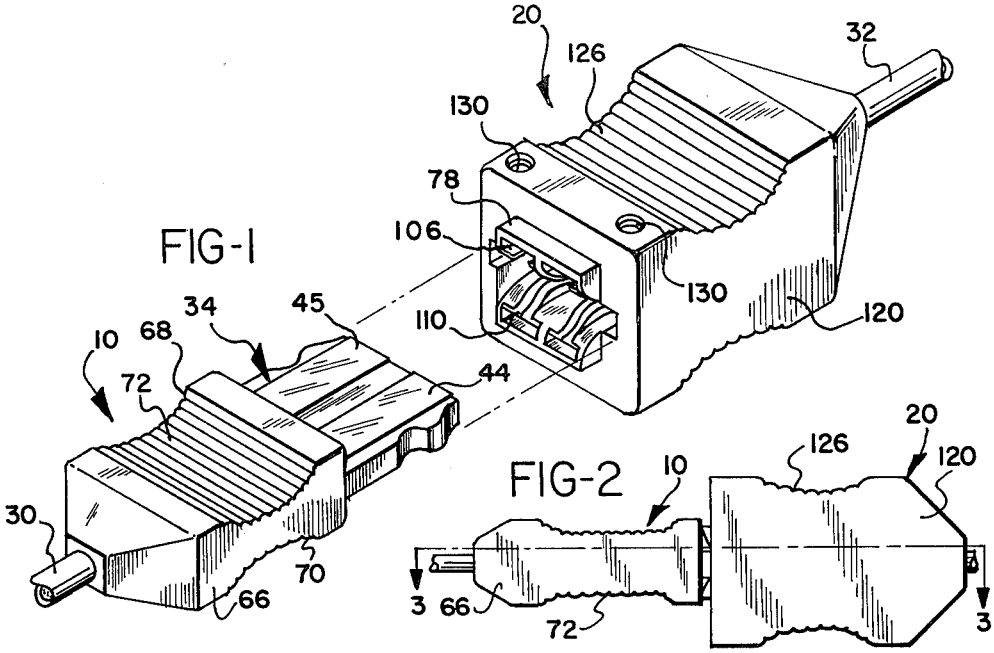
FIG-1
FIG-2
20
126
32
130
78
106
130
120
34
45
10
68
110
72
44
30
70
66
20
126
120
10
3
66
72
3
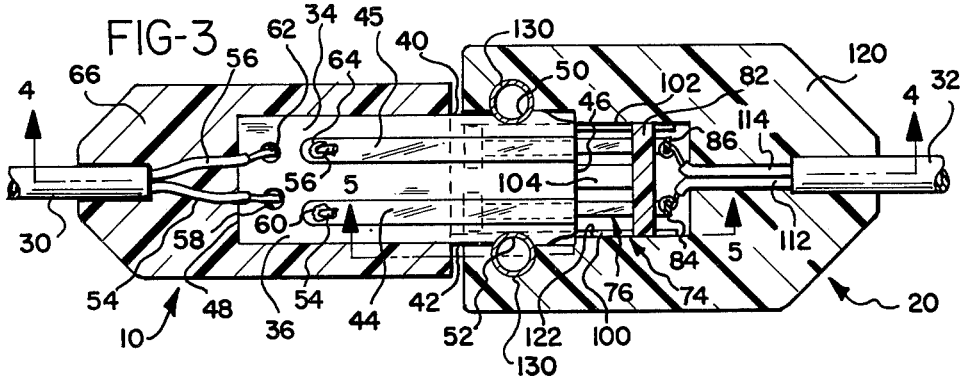
FIG-3
62
34
45
40
130
56
64
50
120
66
102
82
4
46
114
4
32
86
56
5
104
30
60
112
58
84
5
54
48
54
42
76
74
20
10
36
44
52
122
100
130
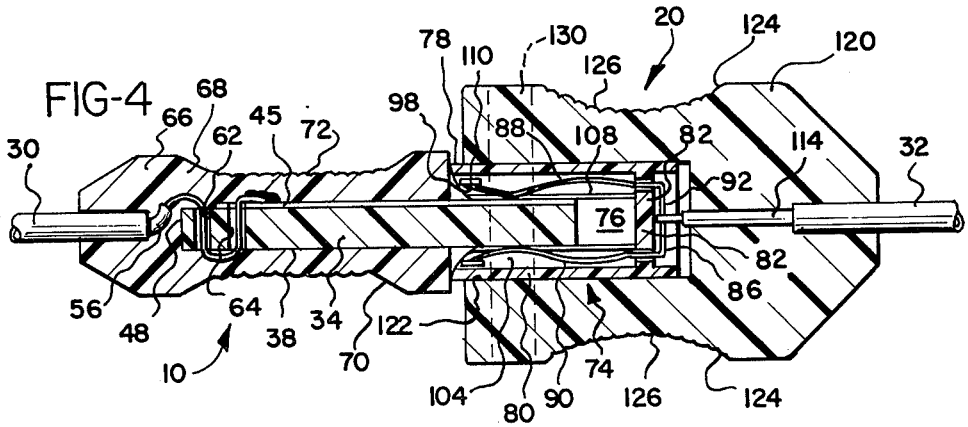
FIG-4
78
110
130
20
124
126
120
68
66
45
72
98
88
108
82
114
30
62
92
32
76
82
86
56
64
34
122
48
38
70
74
10
104
80
90
126
124

ELECTRICAL CABLE CONNECTOR

BACKGROUND OF THE INVENTION

The present invention relates to electrical cable connector devices and, more particularly, to such a device of the plug and socket type having a locking mechanism to insure secure connections. Such devices may find particular application in high accuracy measuring devices utilizing disposable measurement probes, or in any situation where a low cost, high reliability cable connection capable of frequent connection and disconnection is desirable.

In designing electrical cable connectors, it is frequently necessary to insure a mechanically secure connection by including a locking mechanism for the connector. Such a mechanism is particularly helpful in preventing accidental disconnections due to inadvertent bumping, pulling or vibration of the connector. Additionally, a strain relief is often required to reduce strain upon the point of attachment of the cable to the connector, so as to reduce the possibility of separating the cable from the connector.

Typically, low cost connectors are produced by using relatively large tolerances or less expensive materials. Such connectors rely on interlocking tabs on the connector shells to provide a locking mechanism, and/or snap-on clasps to provide strain relief. Because of the use of less expensive materials, typically including contact pins of non-noble metals, high contact resistance is introduced, resulting in low reliability.

High contact resistance is particularly objectionable in connectors for use with high accuracy measuring devices. One possible solution in such cases is the use of large surface areas for electrical contact. This not only results in the use of more material, thereby increasing cost, but also greatly increases the overall size of the connector assembly, making such a connector bulky and awkward to use.

Generally, with presently known connectors, high reliability requirements necessitate the use of a connector of relatively high cost. Such connectors as are typically used with high accuracy measuring devices include those of the MS Series, using solder or crimp pins with a metal housing and nut assembly. MS Series connectors normally require external strain relief and contain from six to fifteen parts in addition to the connector pins. Consequently, such connectors are both relatively large and costly. Additionally, the mating action, which is either twist lock or screw lock, is typically slow to perform.

High reliability locking connectors have also long been necessary for attaching printed circuit boards to the chassis of the device in which they are used. Typical of such connectors are those shown in U.S. Pat. No. 3,216,580 and U.S. Pat. No. 4,008,942. The printed circuit board is inserted into a socket so as to engage a set of contacting members. A locking mechanism is provided generally through the use of locking members extending from the socket along the edges of the circuit board. In the '580 patent, the members are made of a semi-flexible plastic material and have a protrusion at the free end of each. Each protrusion is fittable within a notch in the edge of the board so as to lock the board into place. In the +942 patent, the members are made of spring steel, and are bent such that each forms a crook engageable with a notch in the edge of the board.

While such connectors are generally of high reliability, they are not suitable for use in low cost cable connections. Such connectors are by nature large and bulky, since the printed circuit boards for which they are design are quite large in comparison with a cable. Additionally, the use of locking members extending from the socket add to the size of the connector, as well as the complexity of its manufacture. Moreover, a circuit board connector must be designed so as to facilitate air circulation around the board and its components, whereas cable connections must be completely insulated.

Similarly, high reliability connectors are known for use with flat ribbon cables associated with printed circuit boards. As shown in U.S. Pat. No. 3,149,897 and U.S. Pat. No. 3,737,833, such connectors typically comprise a plug and socket arrangement. A locking mechanism is provided, as in the circuit board connectors, wherein locking members extend outwardly from the socket along the plug edges and engage with notches or projections defined along the edges of the plug. Such connectors tend to be bulky, however, in part due to their use with relatively large ribbon cables, but also due to the use of locking members extending outwardly from the socket. Such connectors require low tolerances and a relatively large number of parts, thereby increasing their cost. Further, especially when the connector is in a disconnected state, the exposed, protruding locking members are subject to bending or breakage.

It is seen, therefore, that a high reliability, low cost electrical cable connector is needed. Such a connector should be of relatively small size, and form a connection that is mechanically secured. A strain relief should be provided. Moreover, the connector should be capable of repeated connections and disconnections without risk of damage to the connector.

SUMMARY OF THE INVENTION

An electrical connector includes a first connector member having a plate-like body of electrically non-conductive material defining opposed relatively wide faces, relatively narrow edges, a connector end, and an attachment end. At least one strip of electrically conductive material on at least one of the faces extends from the connector end to the attachment end of the connector member. A lead wire is anchored to the attachment end and is attached to the conductive strip. The edges of the connector member have retaining notches therein adjacent the connector end thereof.

The first connector member may further include a casing of electrically insulated material covering the portion of the body thereof not insertable within the socket, the attachment end, and a portion of the lead wire attached to the first connector member.

A second connector member includes a housing of resilient electrically insulated material forming a socket with an open end dimensioned to receive the body of the first connector member. A contact member is located within the socket in a position to contact the conductive strip, and further has a portion adapted for attachment to a second lead wire. Rigid retainer pins are incorporated within the housing and extend across the socket, and are spaced apart so as to interfit with the notches of the first connector member. The pins are displaceable in the housing in response to insertion or withdrawal of the first connector member with respect to the second connector member.

The second connector member may further include a relatively rigid body having a slot with an open end and open sides. The slot is dimensioned to receive the connector end and the major areas of the faces of the first connector member, but not the edges thereof. The rigid body is disposed within the housing of the second connector member, such that the slot cooperates with the socket so as to permit insertion or withdrawal of the first connector member thereinto or therefrom.

The contact member may comprise a spring contact member located within the slot in a position to press against the conductive strip of the first contact member.

Accordingly, it is an object of the present invention to provide an electrical cable connector which includes a first connector member having retaining notches in the edges thereof, and a strip of conductive material thereon, a lead wire attached thereto, a second connector member having a housing forming a socket therein, a contact member and retainer pins, and a second lead wire so as to provide a high reliability cable connection; to provide such a connector that is of relatively low cost and of relatively small size; to provide such a connector that forms a mechanically secure connection and a strain relief for the lead wires thereof; and to provide such a connector that is capable of repeated connections and disconnections.

Other objects and advantages of the invention will be apparent from the following description, the accompanying drawings, and the appended claims.

BRIEF DESCRIPTION OF THE DRAWINGS

FIG. 1 is a three-quarter perspective view of the connector of the present invention, showing the connector members in a disconnected state;

FIG. 2 is a side view of the connector, showing the connector members in a connected state;

FIG. 3 is a top sectional view of the connector, taken generally along line 3—3 in FIG. 2.

FIG. 4 is a side sectional view of the connector, taken generally along line 4—4 in FIG. 3;

DETAILED DESCRIPTION OF THE PREFERRED EMBODIMENT

Figure 5:
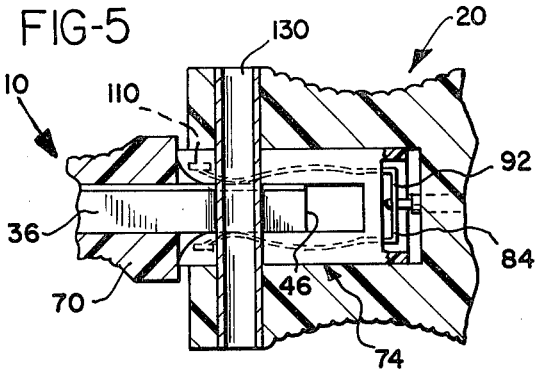
FIG. 5 is a partial side sectional view taken generally along line 5—5 in FIG. 3.

An electrical cable connector as shown in FIG. 1 of the drawings includes generally a first connector member 10 and a second connector member 20. Connector members 10 and 20 are attached to electrical cables 30 and 32, respectively.

Referring now to FIG. 3, connector member 10 includes a plate-like body 34. Body 34 has an upper face 36 and a lower face 38, with relatively narrow edges 40 and 42. Body 34 is constructed of a rigid non-conducting material, and may preferably be a small printed circuit board. Two strips of electrically conductive material 44 and 45 are disposed on upper face 36 of body 34, extending lengthwise thereon from a connector end 46 towards an attachment end 48. It will be recognized, of course, that, while one end of strips 44 and 45 is disposed substantially at connector end 46, strips 44 and 45 need not necessarily extend the full length of body 34 to attachment end 48. Strips 44 and 45 are preferably constructed of a noble metal, so as to provide low contact resistance.

Body 34 defines a pair of notches 50 and 52 within the edges 40 and 42, respectively, thereof.

Cable 30 includes lead wires 54 and 56. Lead wire 54 passes downwardly through a hole 58 defined in body 34 adjacent the attachment end 48 thereof. Wire 54 then passes upwardly through a hole 60 defined in body 34, and is attached to strip 44 by solder applied to wire 54 in hole 60. Similarly, lead wire 56 passes downwardly through a hole 62 defined in body 34, passes upwardly through a hole 64 defined in body 34, and is attached to strip 45 by solder applied within hole 64. The passing of wire 54 through holes 58 and 60, and the passing of wire 56 through holes 62 and 64, provide a strain relief for the connection between cable 30 and connector member 10.

Connector member 10 further includes a casing 66 constructed of an electrically non-conductive material surrounding the attachment portion of body 34 and the attachment portion of cable 30. As shown in FIG. 1, casing 66 defines indentations 68 and 70 within the upper and lower surfaces thereof, respectively. A plurality of lateral ridges 72 are defined within indentations 68 and 70, so as to facilitate gripping of connector member 10 during connection and disconnection of the electrical connector.

Preferably, casing 66 is formed by injection molding of the non-conductive material. This technique provides for bonding between the casing 66 and the portion of the outer surface of cable 30 contained therein, thereby providing an additional strain relief for the connection between cable 30 and connector member 10.

Referring now to FIGS. 3, 4 and 5, connector member 20 includes a rigid body 74 having a slot 76 defined therein with an open end and open sides. Body 74 further has an upper wall 78, a lower wall 80, and a rear wall 82, and is dimensioned so as to receive body 34 of connector member 10.

A pair of spring contact members 84 and 86 are disposed within body 76. Spring contact 84 and spring contact 86 are of similar construction and are generally U-shaped. Spring contact 86 includes an upper leaf 88 disposed adjacent upper plate 78, extending the length thereof, and passing through rear wall 82. A lower leaf 90 is disposed adjacent the lower wall 80 and extends along the length thereof, passing through rear wall 82. A rear portion 92 connects leaves 88 and 90, and is disposed behind rear wall 82. Leaves 88 and 90 are bowed inwardly away from walls 78 and 80, respectively, along a portion of their length, so that the distance between leaves 88 and 90 at their closest point of approach is normally smaller than the thickness of body 34 of connector member 10. When body 34 is inserted into slot 76, body 34 will push apart but remain in contact with the leaves of both spring contacts 84 and 86. Additionally, spring contacts 84 and 86 are disposed such that the upper leaves thereof contact strips 44 and 45, respectively, of body 34 so as to form an electrical connection.

Figure 6:
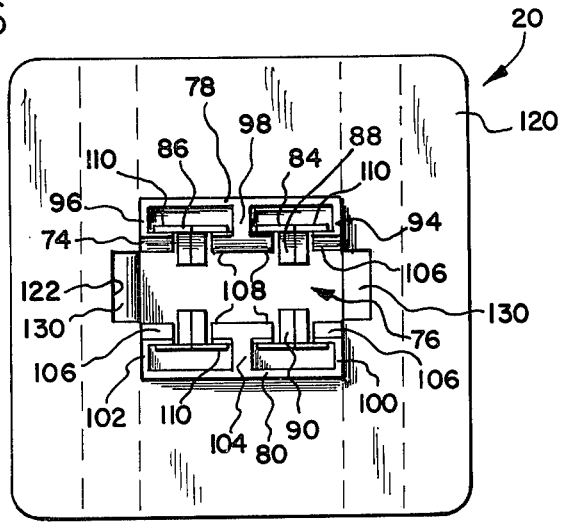
FIG. 6 is an end view of the second connector member, showing the socket defined therein.

To prevent twisting and bending of the leaves of spring contacts 84 and 86 upon insertion of body 34 into slot 76, a retaining means is provided as part of body 74. As indicated in FIG. 6, three divider plates extend downwardly from upper wall 78 along the length thereof. Divider plates 94 and 96 are disposed along the edges of upper wall 78, while divider plate 98 is disposed along the center of wall 78, between contact members 84 and 86. Similarly, three divider plates extend upwardly from the lower wall 80. Divider plates 100 and 102 are disposed along the edges of lower wall 80, extending the length thereof. Divider plate 104 is disposed lengthwise along the center of lower wall 80, between contact members 84 and 86.

Outer divider plates 94, 96, 100 and 102 each include a flange 106 extending the length thereof. Flanges 106 extend inwardly from each outer divider plate, towards the closest adjacent spring contact member. Inner dividing plates 90 and 104 each include a pair of flanges 108 extending lengthwise thereon and on opposite sides thereof. Each flange 108 extends towards an adjacent spring contact member. The leading edges of the leaves of contact members 84 and 86 include tabs 110 extending outwardly therefrom. Each tab 110 is disposed adjacent a flange 106 or 108, such that the leading edges of the leaves of contact members 84 and 86 are prevented from movement from between the dividing plates 94, 96 and 98 of upper plate 78 and dividing plates 100, 102 and 104 of lower wall 80 into slot 76. The leading edges of the leaves of contact members 84 and 86 are therefore always disposed at a greater distance apart than the thickness of body 34 of connector member 10.

As shown in FIG. 3, cable 32 includes two lead wires 112 and 114. Wire 112 is electrically and mechanically connected to spring contact member 84, while wire 114 is electrically and mechanically connected to spring contact member 86. Connector member 20 further includes a housing 120 constructed of a resilient, electrically insulating material. Housing 120 surrounds body 74 and the portion of cable 32 adjacent body 74, with an opening 122 defined therein into which body 74 is fitted, thereby forming a socket for receiving body 34 of connector member 10. Housing 120 further includes indentations 124 defined within each side face thereof. Lateral ridges 126 are defined within each indentation 124 so as to provide a gripping surface for connector member 20 when connecting or disconnecting the electrical connector.

Housing 120 is preferably formed by injection molding of the resilient material. Again, such a method provides for bonding between the material of housing 120 and the contained portion of the outer surface of cable 32. A strain relief is thus provided for the connection between cable 32 and connector member 20.

Connector member 20 further includes a pair of tubular pins 130 extending through housing 120. Pins 130 are disposed adjacent to body 74 and pass across the open sides thereof perpendicular to slot 76. Pins 130 are further disposed to a distance apart so as to interfit one each with notches 50 and 52 of body 34.

The operation of the electrical cable connector is described below. In connecting the connector, body 34 of connector member 10 is inserted into slot 76 of body 74 of connector member 20. Body 34 pushes apart the leaves of spring contact members 84 and 86, thereby establishing electrical contact between spring contacts 84 and 86 and strips 44 and 45, respectively, of body 34. At substantially the same time, edges 40 and 42 of body 34 engage and push against pins 130 in housing 120. Because of the resiliency of the material of housing 120, pins 130 are pushed apart, allowing body 34 to pass therebetween. As body 34 is inserted further into slot 76, pins 130 engage notches 50 and 52 of body 34 thereby locking body 34 into slot 76. The snapping action of pins 130 engaging with notches 50 and 52 provides the user of the electrical connector with both an aural and tactile indication that a secure connection has been made. Additionally, should body 34 be inserted into slot 76 an amount insufficient to allow pins 130 to engage notches 50 and 52, the resilient nature of housing 120 will push pins 130 against body 34, thereby pushing body 34 outwardly from slot 76, providing protection against incomplete connections.

To disconnect the electrical connector, body 34 of connector member 10 is pulled outwardly from slot 76 of connector member 20. Pins 130 are disengaged from notches 50 and 52, and are spread apart as body 34 is moved from therebetween. As body 34 is removed from slot 76, pins 130 return to their normal disposition, and the electrical contact between spring contacts 84 and 86 and strips 44 and 45, respectively, is broken.

Although the present invention as described above represents, in particular, an electric cable connector for two-wire cable, it will be recognized that the invention is suitable for use with cables having various other numbers of wires. For instance, two-wire cables 30 and 32 may be replaced by cables having four wires each. In such a case, two electrically conductive strips similar to strips 44 and 45 are disposed on lower face 38 of body 34, and are attached to the two additional wires of the cable. Similarly, spring contacts 84 and 86 are divided such that each upper leaf 88 and each lower leaf 90 form a separate contact member, connected one each to each of the four wires of the cable.

While the form of apparatus herein described constitutes a preferred embodiment of the invention, it is to be understood that the invention is not limited to this precise form of apparatus and that changes may be made therein without departing from the scope of the invention.

What is claimed is:

1. An electrical connector comprising:

a first connector member including a plate-like body of electrically non-conductive material having opposed relatively wide faces, relatively narrow edges, a connector end, and an attachment end, at least one strip of electrically conductive material on at least one of said faces extending from said connector end toward said attachment end, and a first lead wire anchored to said attachment end and attached to said strip, said edges having retaining notches therein adjacent said connector end, a second connector member including a housing of resilient electrically insulating material forming a socket with an open end dimensioned to receive said body of said first connector member, a contact member located in said socket in position to contact said strip and having a portion adapted for attachment to a second lead wire, rigid retainer pins incorporated in said housing extending across said socket and spaced apart to interfit with said notches, said housing being deformable so as to permit displacement of said pins therein in response to insertion or withdrawal of said first connector member with respect to said second connector member.

2. The connector defined in claim 1, wherein said contact member comprises a spring contact member located in said socket in position to press against said strip, so as to contact said strip.

3. An electrical connector comprising:

a first connector member including a plate-like body of electrically non-conductive material having opposed relatively wide faces, relatively narrow edges, a connector end, and an attachment end, at least one strip of electrically conductive material on at least one of said faces extending from said connector end toward said attachment end, a first lead wire anchored to said attachment end and attached to said strip, said edges having retaining notches therein adjacent said connector end, and a second connector member including a relatively rigid body having a slot with an open end and open sides and dimensioned to receive said first connector end and the major areas of said faces but not said edges, a spring contact member located in said slot in position to press against said strip and having a portion adapted for attachment to a second lead wire, a housing of resilient electrically insulating material surrounding said second connector member except at said open end thereof, said housing having slot portions aligned with said open sides of said slot in said second connector member and cooperating therewith to form a socket for a portion of said body of said first connector member, rigid retainer pins incorporated in said housing extending across said slot portions and spaced apart to interfit with said notches, said housing being deformable so as to permit displacement of said pins therein in response to insertion or withdrawal of said first connector member with respect to said second connector body.

4. The connector defined in claim 3, wherein said first connector member further includes a casing of electrically insulating material covering the portion of said plate-like body not insertable within said second connector member, said attachment end, and a portion of said first lead wire adjacent thereto.

5. The connector defined in claim 4, wherein said plate-like body defines a pair of holes therein substantially at said attachment end thereof, said first lead wire passing in one direction through a first of said holes and in an opposite direction through the second of said holes so as to anchor said first lead wire to said attachment end.

* * * * *